US006585547B2

(12) United States Patent
Tsubouchi et al.

(10) Patent No.: US 6,585,547 B2
(45) Date of Patent: Jul. 1, 2003

(54) OUTBOARD MOTOR

(75) Inventors: Masanori Tsubouchi, Wako (JP); Tomonori Ikuma, Wako (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 1 day.

(21) Appl. No.: 10/068,476

(22) Filed: Feb. 6, 2002

(65) Prior Publication Data

US 2002/0111089 A1 Aug. 15, 2002

(30) Foreign Application Priority Data

Feb. 13, 2001 (JP) ..... 2001-035986

(51) Int. Cl.[7] ..... B63H 21/10

(52) U.S. Cl. ..... 440/88 A; 440/88 R; 123/327; 123/339.23

(58) Field of Search ..... 440/88 R, 88 A, 440/88 F, 77, 900; 123/319, 327, 339.1, 339.23, 184.24, 184.34, 184.42, 184.47, 184.51

(56) References Cited

U.S. PATENT DOCUMENTS 5,704,335 A * 1/1998 Akutagawa et al. ..... 123/337
6,032,633 A * 3/2000 Wada ..... 123/184.24
6,041,754 A * 3/2000 Mori et al. ..... 123/339.23
6,119,653 A * 9/2000 Morikami ..... 123/339.23
6,415,766 B1 * 7/2002 Kanno et al. ..... 123/339.19
6,446,599 B1 * 9/2002 Nakayasu ..... 123/339.23
6,470,852 B1 * 10/2002 Kanno ..... 123/339.23
6,481,411 B1 * 11/2002 Katayama ..... 123/339.23

FOREIGN PATENT DOCUMENTS

JP 10231761 9/1998

* cited by examiner

*Primary Examiner*—S. Joseph Morano
*Assistant Examiner*—Ajay Vasudeva
(74) *Attorney, Agent, or Firm*—Adams & Wilks

(57) ABSTRACT

An outboard motor includes an engine, a throttle valve connected to an inlet air silencer, and an intake manifold connected to a downstream portion of the throttle valve. A control valve is provided between a downstream portion of an intake passageway of the throttle valve and an upstream portion of the intake manifold, for controlling air supply in the low-speed driving of the engine. The control valve has a body formed with an intake passageway. The intake passageway of the body communicates in series with the intake passageway of the throttle valve.

3 Claims, 7 Drawing Sheets

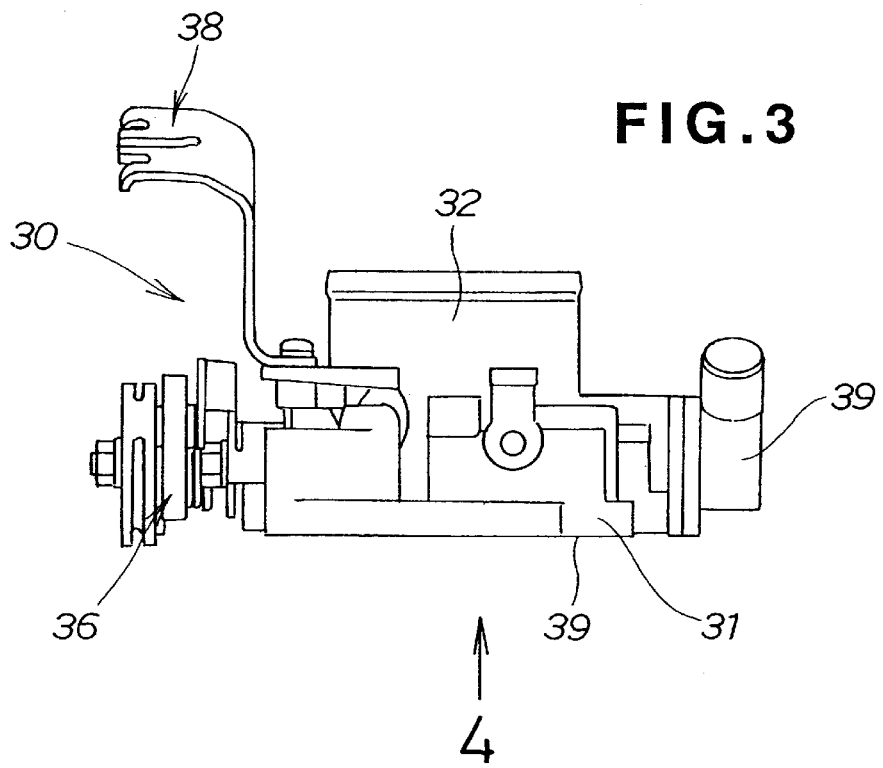
FIG.3
FIG.4
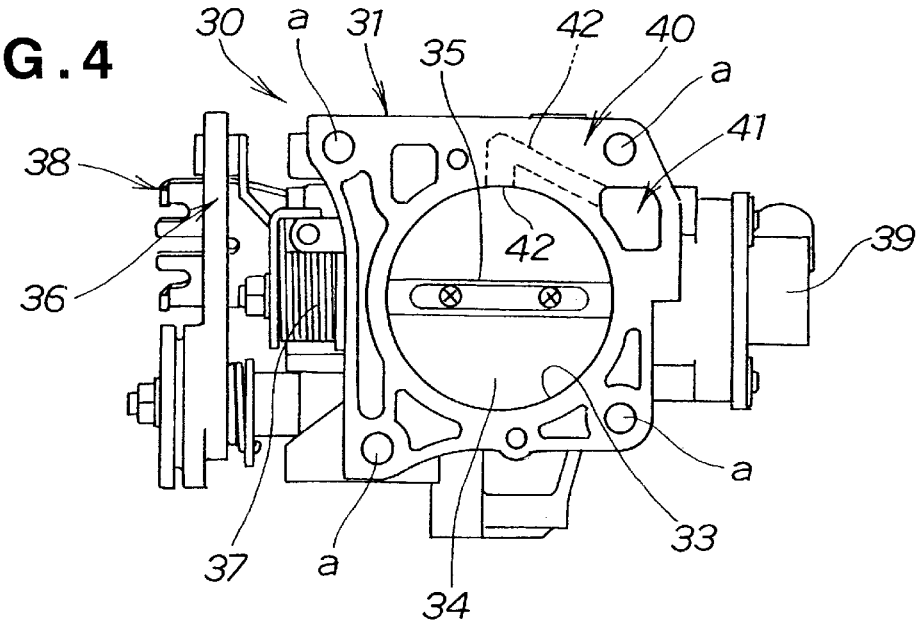

OUTBOARD MOTOR

FIELD OF THE INVENTION

This invention relates generally to an outboard motor and, more particularly, to an arrangement for disposing an electric air control valve (hereinafter refereed to as "EACV") interposed in an inlet system for the low-speed driving of the engine of an outboard motor.

BACKGROUND OF THE INVENTION

An outboard motor is generally provided with an EACV serving as a control valve in an airflow control passageway of a throttle valve, for the engine driven at a low speed (hereinafter referred to as "in low-speed driving"). An arrangement of this kind of EACV is disclosed in Japanese Patent Laid-Open Publication No. HEI-10-231761.

The body of the EACV is mounted in a direction orthogonal to the intake passage of a throttle body of a throttle valve. A solenoid valve attached to the EACV for varying the airflow rate in low-speed driving is provided in a direction orthogonal to a passageway of the EACV. It is thus necessary to leave a space for installing the EACV including the solenoid valve. Since the EACV is mounted to an intake manifold, the shape of the manifold determines the location of the EACV. This requires a large space in an engine space, making the engine space larger, and thus making an engine cover defining the contour of the outboard motor larger, resulting in an outboard motor of a larger size.

It may be conceived to integrally provide in the throttle valve, airflow control passageways constituting the EACV in low-speed driving. This, however, results in a complicated throttle valve structure, leading to significantly troublesome and complicated manufacturing and increased cost.

It may also be conceived to attach the EACV directly to the inlet manifold. In this case, however, the shape of the manifold determines the location of the EACV, being likely to undesirably affect the contour of the engine space. Further, it may be attempted to incorporate the EACV into the throttle valve. In this case, however, the shape of the throttle valve body determines the location of the EACV, causing problems as described above.

SUMMARY OF THE INVENTION

The present invention was made to solve the above problems and provides an outboard motor which allows an EACV to be disposed efficiently in a most-suitable position without putting restrictions on the space around a throttle valve and an intake manifold, thereby preventing an engine space from being enlarged.

According to an aspect of the present invention, there is provided an outboard motor, which comprises: an engine with a crankshaft disposed vertically; an engine cover surrounding the engine and the peripheral equipment, defining an engine space; an intake box for taking air in; a throttle valve with an intake passage, an upstream portion of the intake passage is connected to the intake box; an intake manifold connected to a downstream portion of the intake passage of the throttle valve; and a control valve fitted between a downstream portion of the intake passage of the throttle valve and an upstream portion of the intake manifold via a mounting member, for controlling airflow in low-speed driving of the engine, wherein the mounting member has a body with an intake passage and a supporter extending from the center of the intake passage to a desired position.

In the thus arranged outboard motor, an EACV as an airflow controlling passage device in low-speed driving of the engine is disposed between the downstream intake passageway of the throttle valve and the upstream intake passageway of the intake manifold connected to and communicating with the throttle valve. The position of the EACV is thus in the forward direction of the intake passageway without protruding circumferentially, thereby having a reduced length in the direction of the passageway between the throttle valve and the intake manifold. The supporter is disposed extending from the center of the intake passageway of the EACV, which prevents the outside shape of an intake system including the EACV from being enlarged. With the EACV installed, the engine space and the engine cover defining the engine space are prevented from being enlarged, thereby achieving the compact outside shape of the outboard motor determined by the engine cover. Further, since the EACV is not integrally provided to the throttle valve, which leads to the both devices having simplified structures.

The supporter supports a valve device for providing connection/disconnection between an input port opening into an upstream portion from a throttle plate of the throttle valve and an output port opening into a downstream portion from the throttle plate. In other words, the valve device such as a solenoid valve for connection/disconnection between the input port opening into the upstream portion from the throttle plate of the throttle valve and the output port opening into the downstream portion from the throttle plate is supported by the supporter of the body, so that such a valve as a solenoid valve can be provided without other supporting members being required. The valve device is preferably provided in a parallel relationship with an intake passageway formed in a throttle body.

BRIEF DESCRIPTION OF THE DRAWINGS

Preferred embodiments of the present invention will be described in detail below with reference to the accompanying drawings, in which:

FIG. 3 is a plan view of a throttle valve;

FIG. 4 is a view taken from the angle of arrow 4 in FIG. 3;

DETAILED DESCRIPTION OF THE PREFERRED EMBODIMENTS

Figure 1:
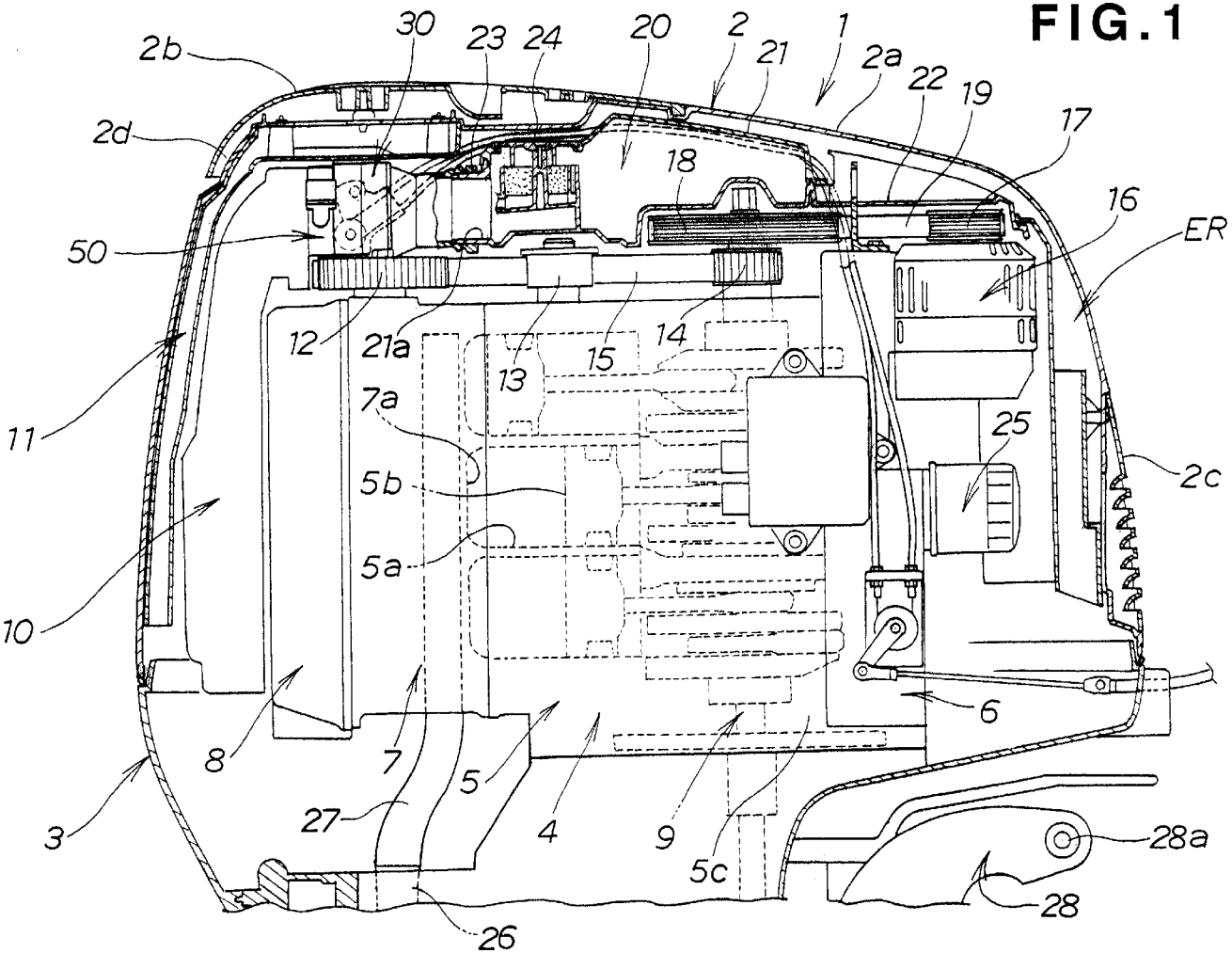
FIG. 1 is a cross-sectional view of an upper portion of an outboard motor according to the present invention.
Figure 2:
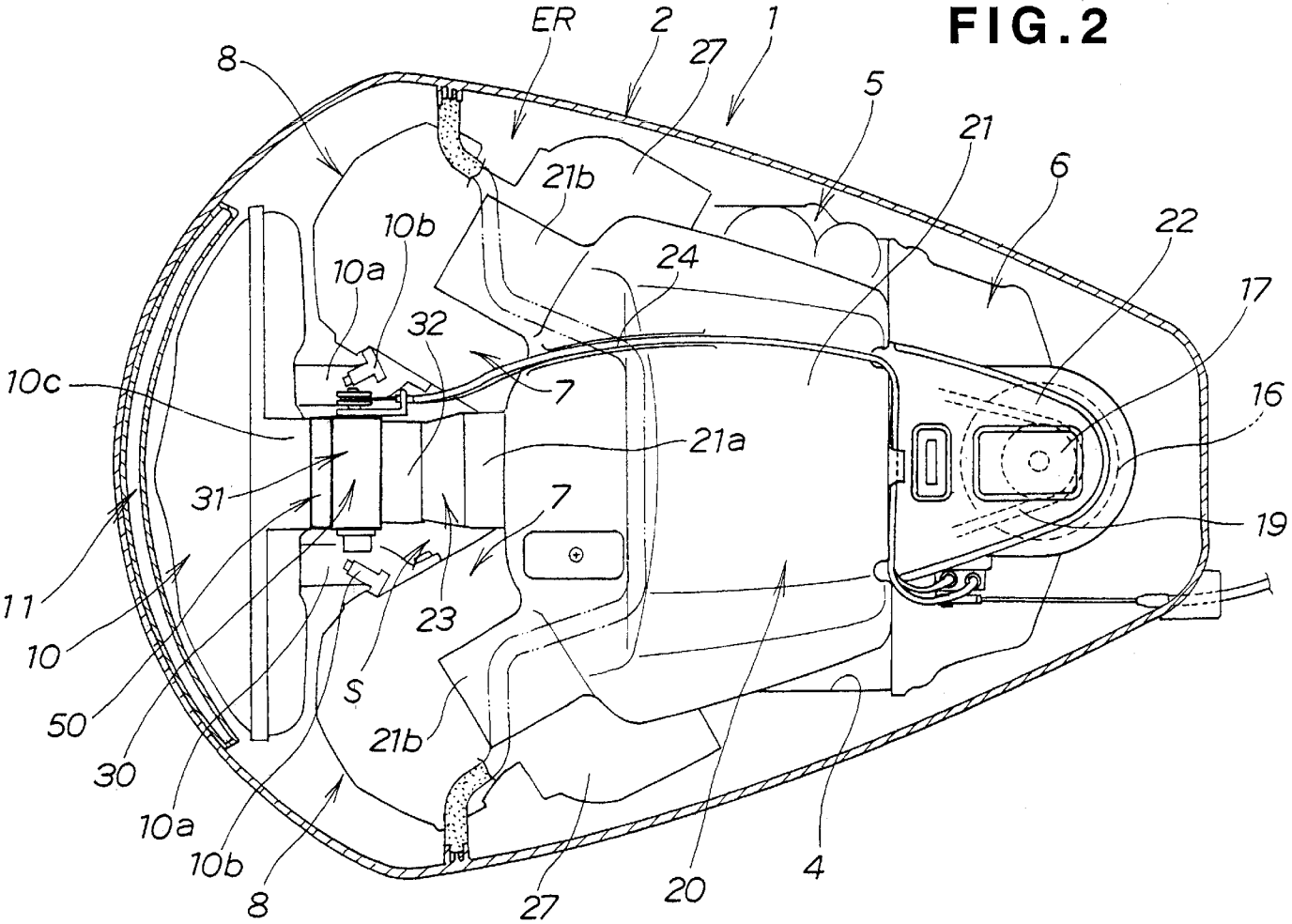
FIG. 2 is a plan view of the outboard motor shown in FIG. 1 with an upper engine cover removed.

Referring to FIGS. 1 and 2, a cover of an outboard motor 1 includes an uppermost engine cover 2, an undercover 3 below the cover 2, an extension case not shown below the cover 3, and a gear case with a screw, not shown, below the extension case. A space surrounded by the engine cover 2 constitutes an engine space ER.

An engine 4 has cylinder blocks 5 positioned in a longitudinally middle portion of the outboard motor 1, a crankcase 6 disposed ahead of skirts 5*c* of the cylinder blocks 5, cylinder heads 7 positioned rearward of the cylinder block 5, and cylinder head covers 8 disposed rearward of the respective cylinder heads 7. The engine 4 used in this outboard motor 1 is a vertical engine with a crankshaft 9 disposed vertically as shown in the figures. The cylinder block 5 has a plurality of horizontal cylinders 5*a* aligned vertically. In this embodiment, three cylinders are vertically arranged. Each cylinder 5*a* incorporates a piston 5*b* which is coupled to the vertical crankshaft 9 via a connecting rod. Each cylinder head 7 has combustion chambers 7*a* for the respective cylinders 5*a*.

The engine 4 is, as shown in FIG. 2 of this embodiment, a V-engine with cylinder axes forming the letter V in a plan view, and more specifically, a V-6 engine with the left and right cylinder blocks 5 each having three horizontal cylinders arranged vertically.

Figure 5:
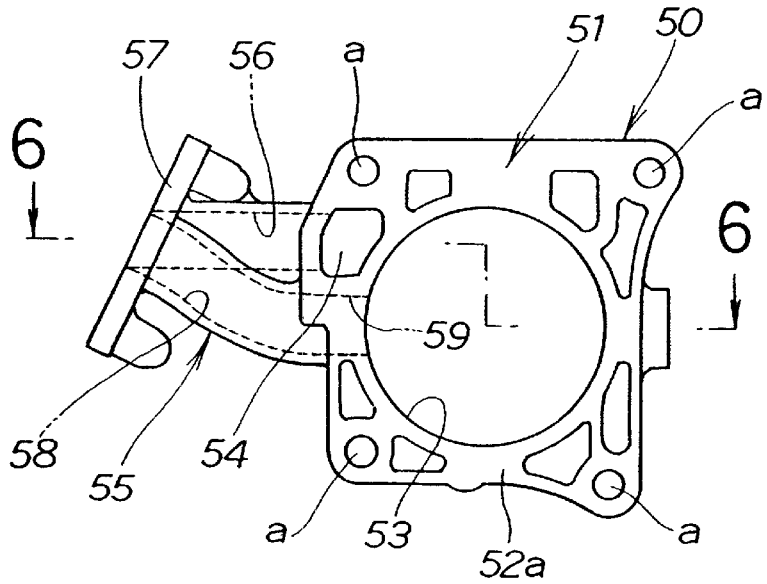
FIG. 5 is a front view of the body of an EACV.

An intake manifold 10 is provided, extending vertically, rearward of the cylinder heads 7 and a V-bank S opening rearward of the engine 4 in a plan view as shown in FIG. 5. A fresh air intake guide 11 is provided rearward of the intake manifold 10.

The intake manifold 10 has a lateral width, constituting a longitudinally thin chamber as shown in FIG. 2.

At the sides of the cylinder heads 8, 8, inlet pipes 10*a*, 10*a* connected to inlet ports of the cylinder heads 8, 8, and fuel injection valves 10*b*, 10*b* are provided, respectively. The inlet pipes 10*a*, 10*a* are positioned within the V-bank S.

As shown in FIG. 1, on the top surface of the engine 4, a camshaft pulley 12 is provided on a top surface of the cylinder head 7, a guide pulley 13 is provided on a rear top surface of the cylinder block 5, and a first drive pulley 14 driven by the crankshaft 9 is provided on a top surface of the skirt 5*c*.

A timing belt 15 is wound around and extended between the camshaft pulley 12 and the first drive pulley 14 so as to drive a camshaft not shown by the crankshaft 9.

An electric generator (AC generator: ACG) 16 is attached to an upper front surface of the crankcase 6. The generator 16 has on its top surface a driven pulley 17 for driving the generator. A second drive pulley 18 is provided coaxially with the first drive pulley 14 on the top end of the crankshaft 9. The second drive pulley 18 and the driven pulley 17 are connected via a timing belt 19 so as to drive the generator 16 by the power from the crankshaft 9.

An inlet air silencer 20 in a box shape serving as an intake box is provided to cover the belt/pulley mechanism positioned above the engine 4. A rear half 21 of the silencer 20 constitutes a cover positioned above the pulley 18 and other parts, and a front half 22 of the silencer 20 is shaped like a shelf and constitutes a cover for the pulley 17 of the generator 16.

The rear half 21 of the silencer 20 integrally has a connecting pipe 21*a* protruding rearward. The connecting pipe 21*a* is connected via a grommet 23 to the upstream portion of an inlet passage of a throttle valve 30 serving as an inlet device provided above a rear portion of the engine 4. The throttle valve 30 will be described in detail later.

A belt cover not shown is provided above the camshaft pulley 12, which cover, if shown in FIG. 1, will appear in front of a lower portion of the throttle valve 30.

In the figures, reference numeral 24 denotes a control cable for regulating the opening of a throttle plate. The control cable 24 extends forwardly along one side of the top surface of the inlet air silencer 20 and is bent vertically downward from the rear half 22 to extend along one side of the crankcase 6, and extends forwardly out of the outboard motor 1 to be connected to an inboard throttle control lever. Reference numeral 25 denotes an oil filter.

Reference numeral 26 denotes an exhaust pipe extending out downwardly. The exhaust pipe 26 is connected to exhaust manifolds 27, 27 provided on the outsides of the left and right cylinder heads 7, 7 as shown in FIG. 2.

The engine cover 2 covers the engine 4 and the associated equipment. The engine cover 2 comprises a cover body 2*a*, a top cover 2*b*, and a front cover 2*c* in a lid shape with fresh air inlet slits provided in a front lower portion thereof. Fresh air intake port 2*d* is provided between a rear upper part of the cover body 2*a* and a rear part of the top cover 2*b* for introducing fresh air into the engine space ER.

In FIG. 1, reference numeral 28 denotes a stern bracket provided forward of the under cover 3 and the extension case not shown, extending therebetween. As is well known, the outboard motor 1 is mounted to the stern of a hull not shown via the stern bracket 28 which is swung laterally on a swivel shaft not shown for steering and is moved up and down on a tilt shaft 28.

Above the engine 4, the upstream intake passage of the throttle valve 30 is connected for communication to the downstream portion of the connecting pipe 21*a* provided at a laterally middle portion of the rear of the inlet air silencer 20 arranged longitudinally of the outboard motor 1. The downstream intake passage of the throttle valve 30 is connected for communication to a tubular connecting port 10*c* upstream of the intake manifold 10 arranged rearward of the cylinder head covers 8, 8 of the engine 4. An electric air control valve (EACV) 50 for controlling the airflow rate in low-speed driving of the engine is interposed between the connecting port 10*c* and the downstream intake passage of the throttle valve 30.

Now with reference to FIGS. 3 and 4, the throttle valve 30 will be described in detail.

The throttle body 31 is generally in a rectangular shape in a plan view. Reference sign Fr indicates the upstream side. The throttle body 31 has a connecting tube 32 protruding forward to be connected to the connecting pipe 21*a* of the inlet air silencer 20 via the grommet 23.

The throttle body 31 has an intake passage 33 as a circular passageway extending therethrough in a longitudinal direction. A throttle plate 34 is fixed in the intake passage 33 via a throttle shaft 35 horizontally provided, to be openable/closable. A cam arm 36, a return torsion spring 37, and a support arm 38 for the control cable 24 which constitute an opening control mechanism for the throttle plate 34 are provided at one side of the throttle body 31. At the other side of the throttle body 31, an opening sensor 39 for detecting the degree of opening of the throttle plate 34 is provided.

Figure 8:
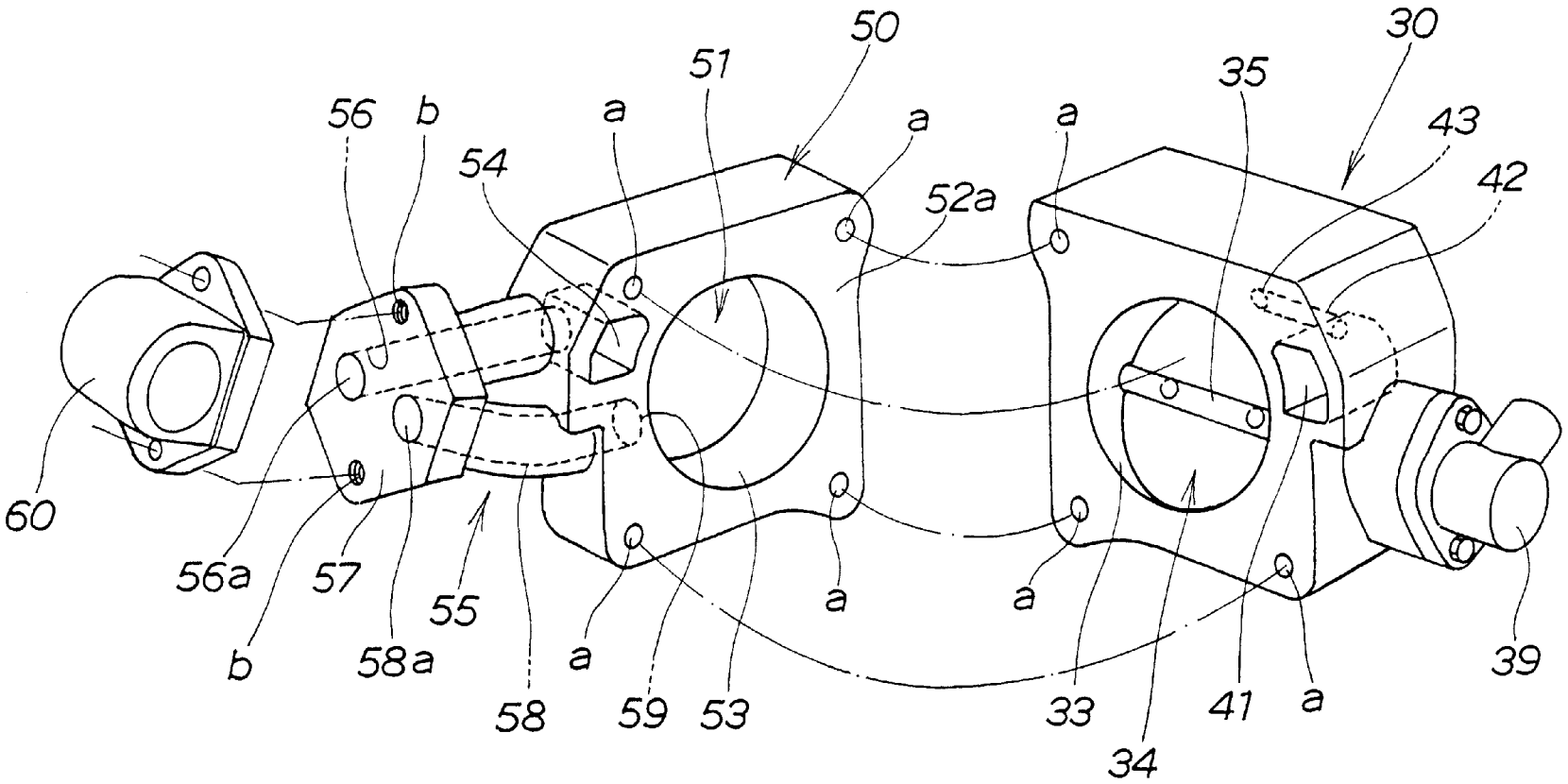
FIG. 8 is a perspective view of the throttle valve and the EACV exploded.

The downstream end (rear end) of the throttle body 31 of the throttle valve 30 constitutes a flat mounting flange face 40. The flange face 40 has a connecting port 41, into a portion of which a bypass passage opens. The connecting port 41 communicates with a bypass passage 42 formed in the throttle body 31. The bypass passage 42 is formed upstream of the throttle plate 34 provided in the intake passage 33 of the throttle body 31, and communicates with an induction port 43 as shown in FIG. 8.

Figure 6:
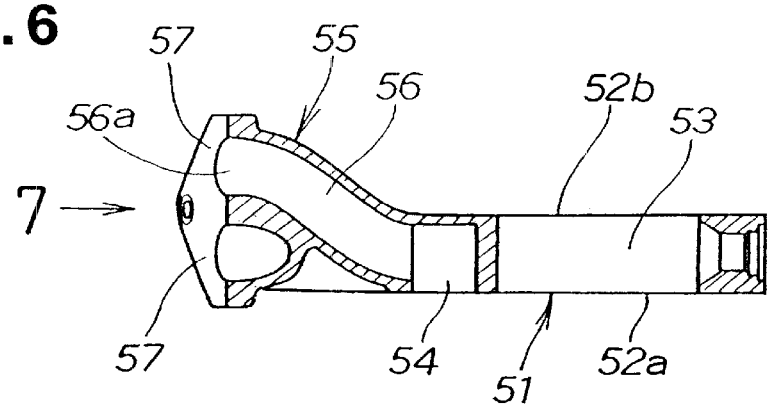
FIG. 6 is a cross-sectional view taken along line 6—6 in FIG. 5.
Figure 7:
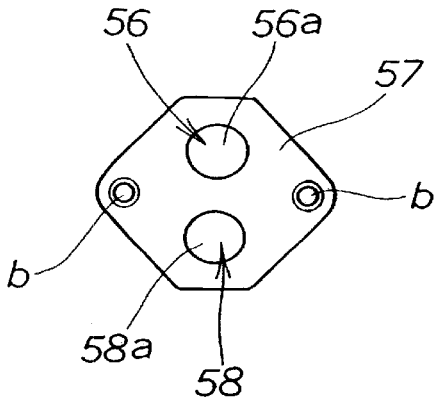
FIG. 7 is a view taken from the angle of arrow 7 in FIG. 6, showing a mounting flange.

Now with reference to FIGS. 5 to 7, the EACV 50 will be described.

A body 51 of the EACV 50 has an intake passage 53 conforming to the intake passage 33 formed in the throttle body 31 of the throttle valve 30 for communication therewith. The body 51 has a mounting face 52*a* upstream (in the front surface) to be closely contacted with the flange face 40 of the throttle body 31 of the throttle valve 30. The bodies 31, 51 are coupled to one another via bolts or the like inserted into mounting holes "a" formed in four corners of the flange face 40 of the body 31 of the throttle valve 30 and in four corners of the mounting face 52*a*. A mounting face 52*b* downstream (in the rear surface) of the body 51 is closely contacted with the upstream tubular connecting port 10*c* of the intake manifold 10 as shown in FIG. 2.

The mounting face 52*a* is formed with a connecting port 54 to be connected to the connecting port 41 formed in the throttle body 31 of the throttle valve 30. A supporter 55 in a block shape protruding radially outward of the intake passage 53 is integrally provided at one side of the body 51.

A bypass passage 56 communicating with the connecting port 54 is provided in the supporter 55. The upstream portion of the bypass passage 56 communicates with the connecting port 54 disposed to form a right angle with the passage 56.

A mounting flange 57 is provided at the end of the supporter 55 for mounting a valve device 60 (solenoid valve described later) for connection/disconnection between an input port and an output port of the EACV.

The mounting flange 57 has an opening 56*a* downstream of the bypass passage 56 and an opening 58*a* upstream of the bypass passage 58 provided adjacent to the bypass passage 56. The downstream portion of the bypass passage 58 is an air supply port 59 in the low-speed driving of the engine. The supply port 59 communicates with the intake passage 53 of the body 51.

FIG. 8 clearly shows the air passage 43, 42 and 41 formed in the body 31 of the throttle valve 30 and the air passage 54, 56, 58 and 59 provided in the body 51 of the EACV 50.

As shown in FIG. 8, the valve device 60 for connection/disconnection between the bypass passage 56 as an input port and the bypass passage 58 as an output port is attached to the mounting flange 57 of the supporter 55 of the body 51 via screws inserted into mounting holes "b, b." An electromagnetic solenoid valve may be used for the valve device 60, for example. The electromagnetic solenoid adjusts the amount of airflow.

Figure 9:
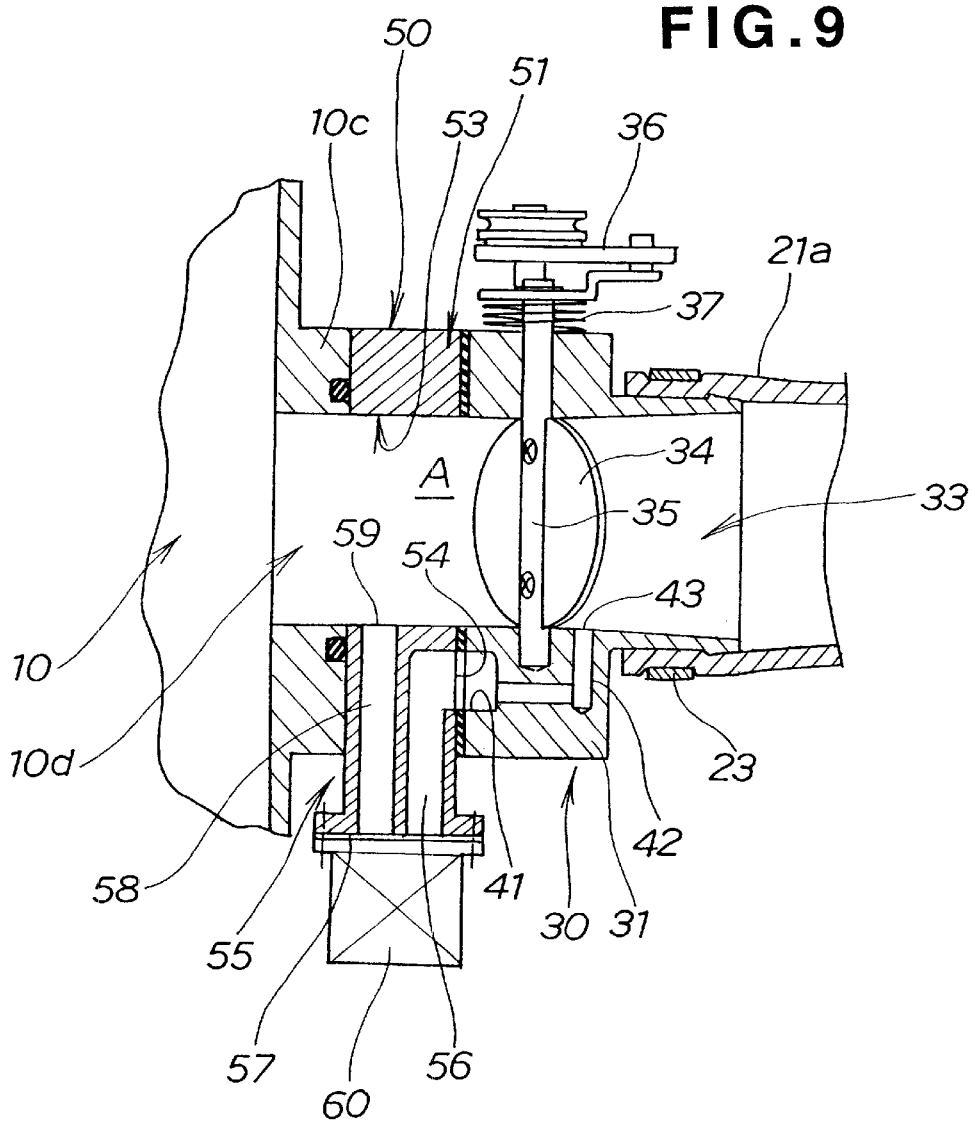
FIG. 9 is a cross-sectional view showing the EACV interposed between the throttle valve and an intake manifold to be provided in an intake passageway.

Referring to FIG. 9, the body 51 of the EACV 50 is interposed between the downstream portion of the throttle plate 34 in the intake passageway "A" and the tubular connecting port 10*c* upstream of the intake manifold 10. The intake passageways 33, 53 communicate with the intake port 10*d* of the intake manifold 10. That is, the body 51 of the EACV 50 is connected to the upstream portion of the intake port 10*d* of the intake manifold 10, the throttle valve 30 is connected to the upstream portion of the body 51, and the throttle valve 30 is connected to the connecting pipe 21*a* of the inlet air silencer.

The opening function of the valve device 60 provides connection between the bypass passages 56 and 58. The input port (induction port 43 upstream of the throttle plate 34, passage 42, ports 41, 54 and passage 56) is connected to the output port (passage 58 and supply port 59) so as to supply air upstream from the throttle plate 34 downstream of the throttle plate 34 when the intake passageway A is closed.

Figure 10:
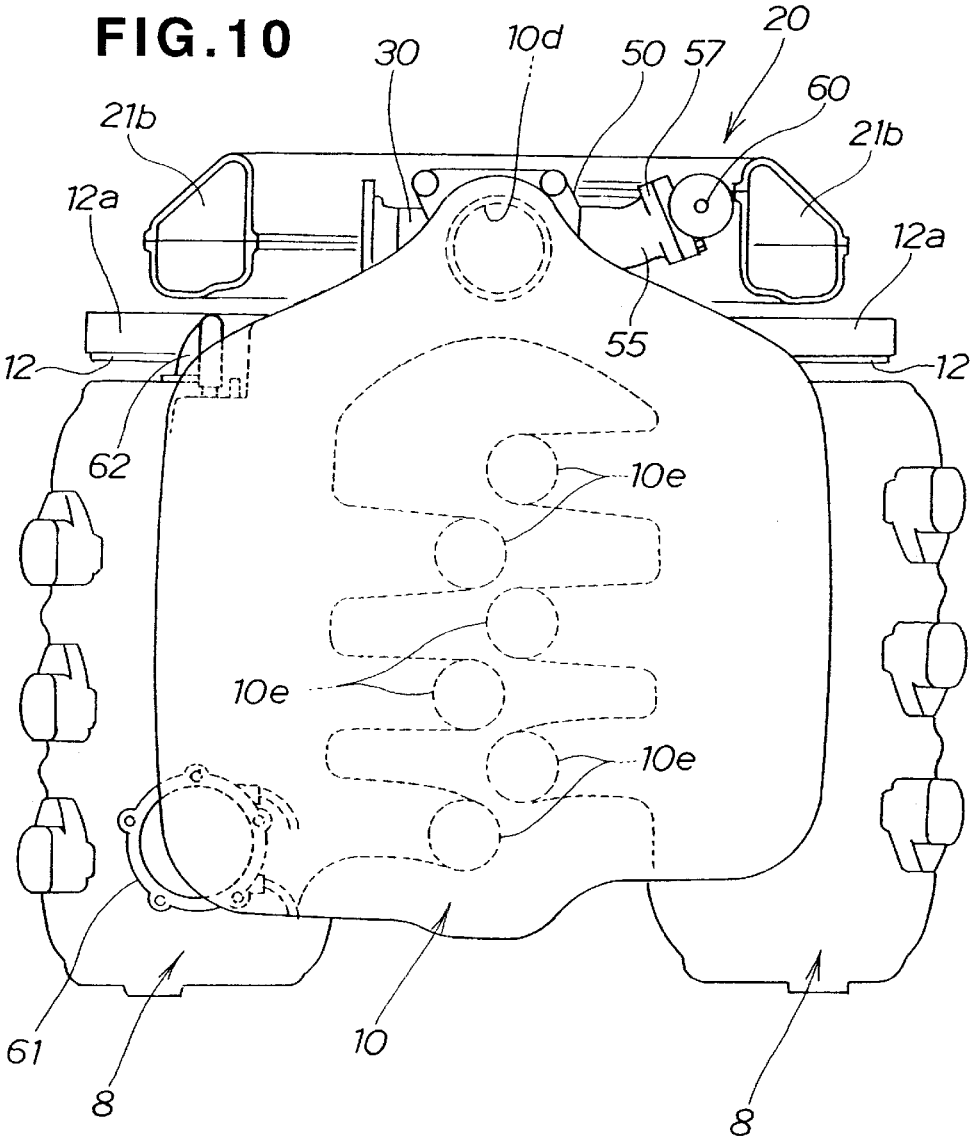
FIG. 10 is a rear view of an engine.

FIG. 10 shows the engine from the rear with the cover and other equipment omitted.

The intake manifold 10 has a total of six inlet ports 10*e* with three aligned vertically in left and right rows. The inlet air silencer 20 has left and right fresh air intakes 21*b*, 21*b* in the rear surface.

The supporter 55 is protruded to the right in the figure, and the valve device 60 is attached to the mounting flange face 57 provided in the outside surface of the supporter 55. The valve device 60 is attached to the mounting flange 57 in a parallel relationship with the intake passageway of the throttle body 31 shown in FIG. 9 (in the longitudinal direction of the outboard motor).

Reference numeral 61 denotes a fuel pump provided rearward of one of the cylinder head covers 8. The fuel pump 61 is driven by a camshaft. Reference numeral 62 denotes a positive crankcase ventilation (PCV) valve. Reference numerals 12*a*, 12*a* denote a cover for the camshaft pulley 12 shown in FIG. 1.

The present disclosure related to the subject matter of Japanese Patent Application No. 2001-035986, filed Feb. 13, 2001, the disclosure of which is expressly incorporated herein by reference.

What is claimed is:

1. An outboard motor comprising:

an engine with a crankshaft disposed vertically;

an engine cover surrounding said engine and peripheral equipment defining an engine space;

an intake box for taking air in;

a throttle valve with an intake passage, an upstream portion of said intake passage of said throttle valve being connected to said intake box;

an intake manifold connected to a downstream portion of said intake passage of said throttle valve; and a control valve, fitted between the downstream portion of said intake passage of said throttle valve and an upstream portion of said intake manifold via a mounting member, for controlling airflow in low-speed driving of said engine, said mounting member having a body with an intake passage and a supporter extending from the center of said intake passage to a desired position.

2. An outboard motor as set forth in claim 1 wherein said supporter supports a valve device for providing connection/disconnection between an input port opening into an upstream portion from a throttle plate of said throttle valve and an output port opening into a downstream portion from said throttle plate.

3. An outboard motor as set forth in claim 2, wherein said valve device is provided on said supporter in a parallel relationship with an intake passageway formed in a throttle body of said throttle valve.

* * * * *